US008267759B2

(12) United States Patent
McNulty et al.

(10) Patent No.: US 8,267,759 B2
(45) Date of Patent: Sep. 18, 2012

(54) SUB-DUCT AND METHOD OF EXHAUSTING INTO A GENERALLY VERTICAL MAIN SHAFT

(75) Inventors: Timothy Edward McNulty, Dallas, TX (US); Brian William Ryglewicz, New York, NY (US); Mark Steven Sylvia, Westerly, RI (US)

(73) Assignee: Subduct Riser Manufacturing, Ltd., Dallas, TX (US)

( * ) Notice: Subject to any disclaimer, the term of this patent is extended or adjusted under 35 U.S.C. 154(b) by 549 days.

(21) Appl. No.: 11/507,135

(22) Filed: Aug. 18, 2006

(65) Prior Publication Data

US 2007/0042705 A1 Feb. 22, 2007

Related U.S. Application Data

(60) Provisional application No. 60/709,167, filed on Aug. 18, 2005.

(51) Int. Cl.
*F24C 3/00* (2006.01)

(52) U.S. Cl. ..... 454/339

(58) Field of Classification Search ..... 454/184, 454/187, 339

See application file for complete search history.

(56) References Cited

U.S. PATENT DOCUMENTS

| | | | | |
|---|---|---|---|---|
| 732,698 | A | | 7/1903 | Beddow |
| 1,890,930 | A | | 12/1932 | Blackmore |
| 2,044,761 | A | | 6/1936 | Becvar |
| 2,462,383 | A | | 2/1949 | Goodwin |
| 3,855,814 | A | * | 12/1974 | Eubank ..... 62/244 |
| 3,892,049 | A | | 7/1975 | Adams |
| 5,099,587 | A | * | 3/1992 | Jarosch ..... 34/202 |
| 5,121,948 | A | * | 6/1992 | Anderson et al. ..... 285/147.1 |
| 5,323,761 | A | | 6/1994 | Vartiainen |
| 5,590,477 | A | | 1/1997 | Carfagno |
| 5,645,482 | A | | 7/1997 | Moss |
| 5,819,435 | A | * | 10/1998 | Tuggle ..... 34/235 |
| 6,161,310 | A | * | 12/2000 | Tuggle et al. ..... 34/480 |
| 6,230,418 | B1 | | 5/2001 | Gomulinski |
| 6,234,163 | B1 | | 5/2001 | Garrod |
| 6,431,611 | B1 | | 8/2002 | Andersen |
| 6,499,231 | B1 | * | 12/2002 | Bradley ..... 34/235 |
| 6,754,976 | B1 | * | 6/2004 | Edwards ..... 34/140 |

* cited by examiner

*Primary Examiner* — Steven B McAllister
*Assistant Examiner* — Samantha Miller
(74) *Attorney, Agent, or Firm* — Lathrop & Gage LLP

(57) ABSTRACT

Sub-ducts and methods of exhausting into a generally rectangular and vertical main shaft are disclosed herein. A sub-duct of one embodiment includes hollow first and second portions. The first portion presents a generally flat attaching wall, a top side that defines an opening, and a bottom side that has an aerodynamic configuration; the second portion defines an intake opening, meets with the first portion attaching wall at approximately a ninety degree angle, and has a configuration complementary to a configuration of an exhaust duct. The first and second portions collectively define a continuous channel between the intake opening and the top side opening. The first portion may have a section of generally constant cross section extending from adjacent the second portion to the top side opening, and the second portion may have a generally constant cross section extending from the intake opening to the first portion.

18 Claims, 6 Drawing Sheets

SUB-DUCT AND METHOD OF EXHAUSTING INTO A GENERALLY VERTICAL MAIN SHAFT

RELATED APPLICATIONS

The present application claims benefit of priority to provisional U.S. Patent Application No. 60/709,167, filed Aug. 18, 2005 and titled "Apparatus For Penetrating A Shaft In Multi-Story Buildings", which is incorporated herein by reference.

BACKGROUND

The present invention relates to an exhausting apparatus, and more particularly to an apparatus for penetrating a shaft in multi-story buildings.

In the age of the high rise condo, architects and engineers are forced to provide new solutions for venting appliances and bathrooms in individual units. In the past, these appliances were vented straight to the outside wall on each floor. However, due to aesthetics and cost, the sidewall option is losing favor. As a result, designers are providing interior shafts to exhaust these appliances and bathrooms.

According to international building codes, fire rated shafts cannot be penetrated unless fire dampers are installed at every penetration or a steel sub-duct protrudes into the shaft and rises at least twenty-two inches. These sub-ducts are often clumsy and occupy excessive space in the main shaft, increasing the pressure drop incurred by the exhaust gases in the main shaft. There is a need in the art for a sub-duct that is able to penetrate the main shaft while meeting fire code, is easy to install, occupies a minimal amount of space, and minimizes pressure drop.

SUMMARY

A method of exhausting into a generally rectangular and vertical main shaft according to one embodiment includes the steps of 1) providing a sub-duct; 2) providing an exhaust duct; 3) coupling the sub-duct to the main shaft; 4) coupling the exhaust duct to the sub-duct; and 5) passing exhaust from the exhaust duct, through the sub-duct, and into the main shaft. The sub-duct includes hollow first and second portions. The first portion presents an attaching wall, a rectangular cross-section, a top side that defines an opening, and a bottom side that has a rounded configuration; the second portion defines an intake opening and meets with the first portion attaching wall at approximately a ninety degree angle. The first and second portions collectively define a continuous channel between the intake opening and the top side opening. The step of coupling the sub-duct to the main shaft includes coupling the attaching wall generally flush with an inner wall of the main shaft so that the sub-duct is aligned in a generally vertical direction.

A method of exhausting into a generally rectangular and vertical main shaft according to another embodiment includes the steps of 1) providing a sub-duct; 2) providing an exhaust duct; 3) coupling the sub-duct to the main shaft; 4) coupling the exhaust duct to the sub-duct; and 5) passing exhaust from the exhaust duct, through the sub-duct, and into the main shaft. The sub-duct includes hollow first and second portions. The first portion presents a generally flat attaching wall, a top side that defines an opening, and a bottom side that has an aerodynamic configuration; the second portion defines an intake opening, meets with the first portion attaching wall at approximately a ninety degree angle, and has a configuration complementary to a configuration of an exhaust duct. The first and second portions collectively define a continuous channel between the intake opening and the top side opening. The step of coupling the sub-duct to the main shaft includes coupling the attaching wall generally flush with an inner wall of the main shaft so that the sub-duct is aligned in a generally vertical direction.

A method of exhausting into a generally rectangular and vertical main shaft according to another embodiment includes the steps of 1) providing first and second sub-ducts; 2) providing first and second exhaust ducts; 3) coupling the respective sub-ducts to the main shaft; 4) coupling the respective exhaust ducts to the sub-ducts; and 5) passing exhaust from the exhaust ducts, through the sub-ducts, and into the main shaft. Each sub-duct includes hollow first and second portions. Each first portion presents a generally flat attaching wall, a top side that defines an opening, and a bottom side that has an aerodynamic configuration; each second portion defines an intake opening, meets with a respective first portion attaching wall at approximately a ninety degree angle, and has a configuration complementary to a configuration of a respective exhaust duct. Respective first and second portions collectively define continuous channels between the intake openings and the top side openings. The step of coupling the sub-ducts to the main shaft includes coupling the attaching walls generally flush with one or more inner wall of the main shaft so that the sub-ducts are aligned in a generally vertical direction. The second sub-duct is positioned above the first sub-duct.

A sub-duct for exhausting into a vertical main shaft according to an embodiment includes hollow first and second portions. The first portion presents a generally flat attaching wall, a top side that defines an opening, and a bottom side that has an aerodynamic configuration; the second portion defines an intake opening, meets with the first portion attaching wall at approximately a ninety degree angle, and has a configuration complementary to a configuration of an exhaust duct. The first and second portions collectively define a continuous channel between the intake opening and the top side opening. The first portion has a section of generally constant cross section extending from adjacent the second portion to the top side opening, and the second portion has a generally constant cross section extending from the intake opening to the first portion.

DETAILED DESCRIPTION

Figure 1:
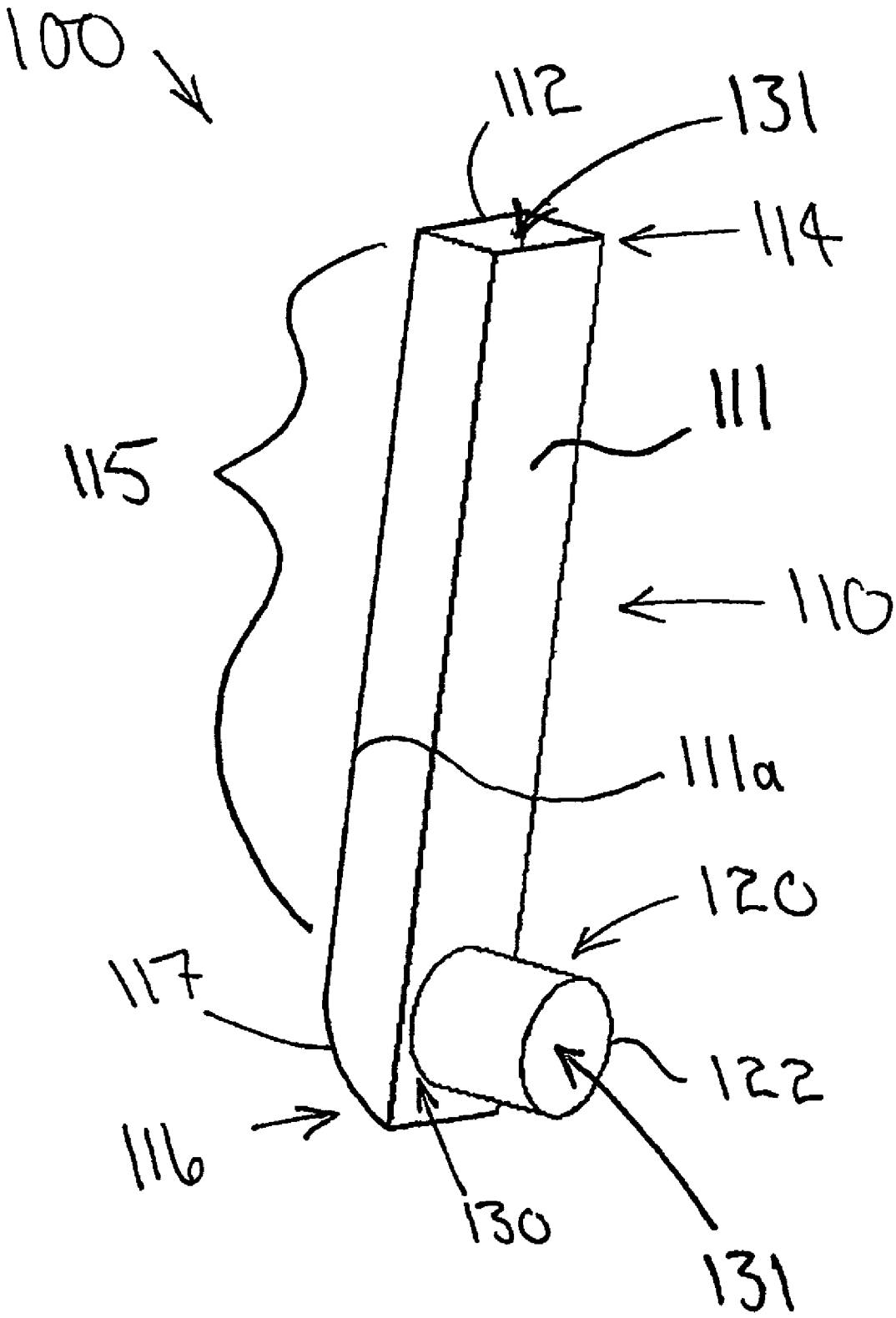
FIG. 1 is a perspective view of a sub-duct according to an embodiment.
Figure 2:
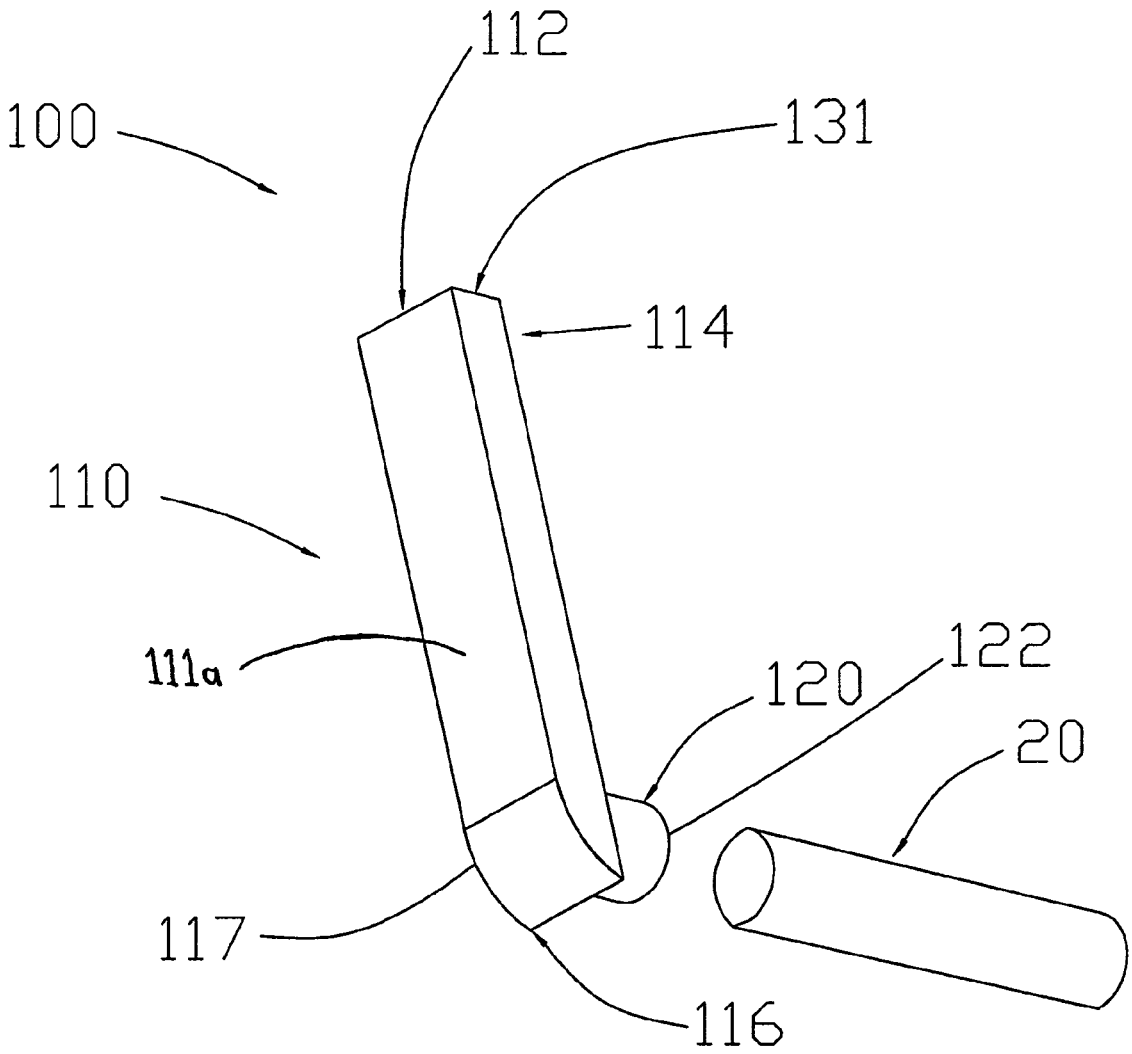
FIG. 2 is another perspective view of the sub-duct as in FIG. 1, with an exhaust duct.
Figure 3:
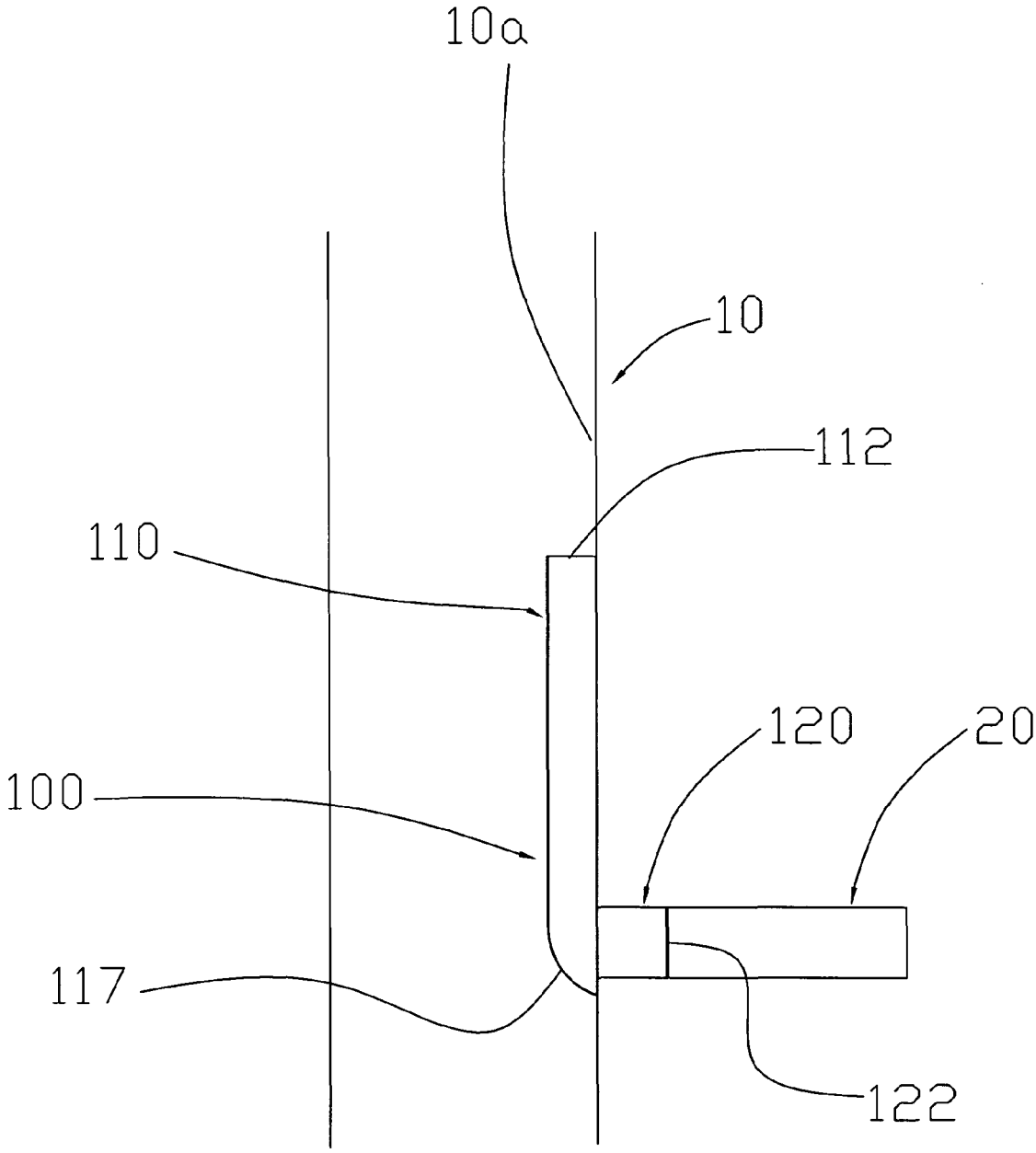
FIG. 3 is a side view of the sub-duct as in FIG. 1 mounted in a main shaft.

FIGS. 1 through 4 show a sub-duct 100 according to an embodiment. The sub-duct 100 includes hollow first and second portions 110, 120. The first portion 110 has an attaching wall 111 which may be generally planar and top and bottom sides 114, 116. The top side 114 defines an opening 112, the second portion 120 defines an intake opening 122, and the first and second portions 110, 120 define a continuous channel 131 and meet at an angle 130 to allow air to pass from the intake opening 122 through the top side opening 112. The angle 130 may be, for example, ninety degrees, which may allow the first portion 110 to extend generally vertically within the main interior shaft 10 and the second portion 120 to extend generally horizontally from a wall (FIG. 3). As shown in FIG. 1, the second portion 120 meets the attaching wall 111 adjacent the bottom side 116.

The first portion bottom side 116 may have an aerodynamic configuration 117 to reduce the interference of air flow in the main interior shaft. As shown in FIGS. 1 and 2, for example, the first portion bottom side 116 may be rounded so that the attaching wall 111 is longer than a wall 111*a* opposite the attaching wall 111 to provide better flow characteristics for exhaust inside the channel 131 and/or exhaust passing the sub-duct 100 in the main shaft 10. Though not shown, the aerodynamic configuration 117 may alternately be angled or even have some other aerodynamically advantageous shape instead of rounded.

The first portion 110 may have a section 115 of generally constant cross section extending from adjacent the second portion 120 to the top side opening, and the second portion 120 may have a generally constant cross section extending from the intake opening 122 to the first portion 110. As shown in FIGS. 1 and 2, the generally constant cross section of the first portion 110 may be rectangular, and the generally constant cross section of the second portion 120 may be rounded, though other cross-sectional arrangements could be used as well and still fall within the scope of the present invention. The first portion 110 may be at least twenty-two inches long to meet applicable building codes.

The second portion 120 may have a configuration complementary to a configuration of an exhaust duct 20 (FIG. 2). As such, the size of the second portion 120 may be determined by the round diameter that the intake opening 122 will be accepting from the exhaust duct 20 (e.g., an appliance exhaust duct, bathroom exhaust duct, etc.); the size of the second portion 120 may typically range from three inches to eight inches in round diameter, though other dimensions or shapes may be possible. The size of the first portion 110 may be related to the size of the second portion 120, and the size of the second portion 120 may be converted into rectangular or semi-circular dimensions, for example, to obtain the size of the first portion 110. It may be desirable for the cross-sectional area of the first portion 110 (i.e., the cross-sectional area of the first portion opening 112) to be at least as large as the cross-sectional area of the second portion 120 (i.e., the cross-sectional area of the intake opening 122) to allow generally unrestricted flow between the first and second portions 110, 120, though it may be acceptable to reduce the cross-sectional area of the first portion 110 by up to approximately five percent. For example, a four inch diameter round intake opening 122 (which has a cross-sectional area of 12.57 square inches) may be converted into a three inch by 4.19 inch rectangular first portion opening 112 (which has a cross-sectional area of 12.57 square inches).

Figure 4:
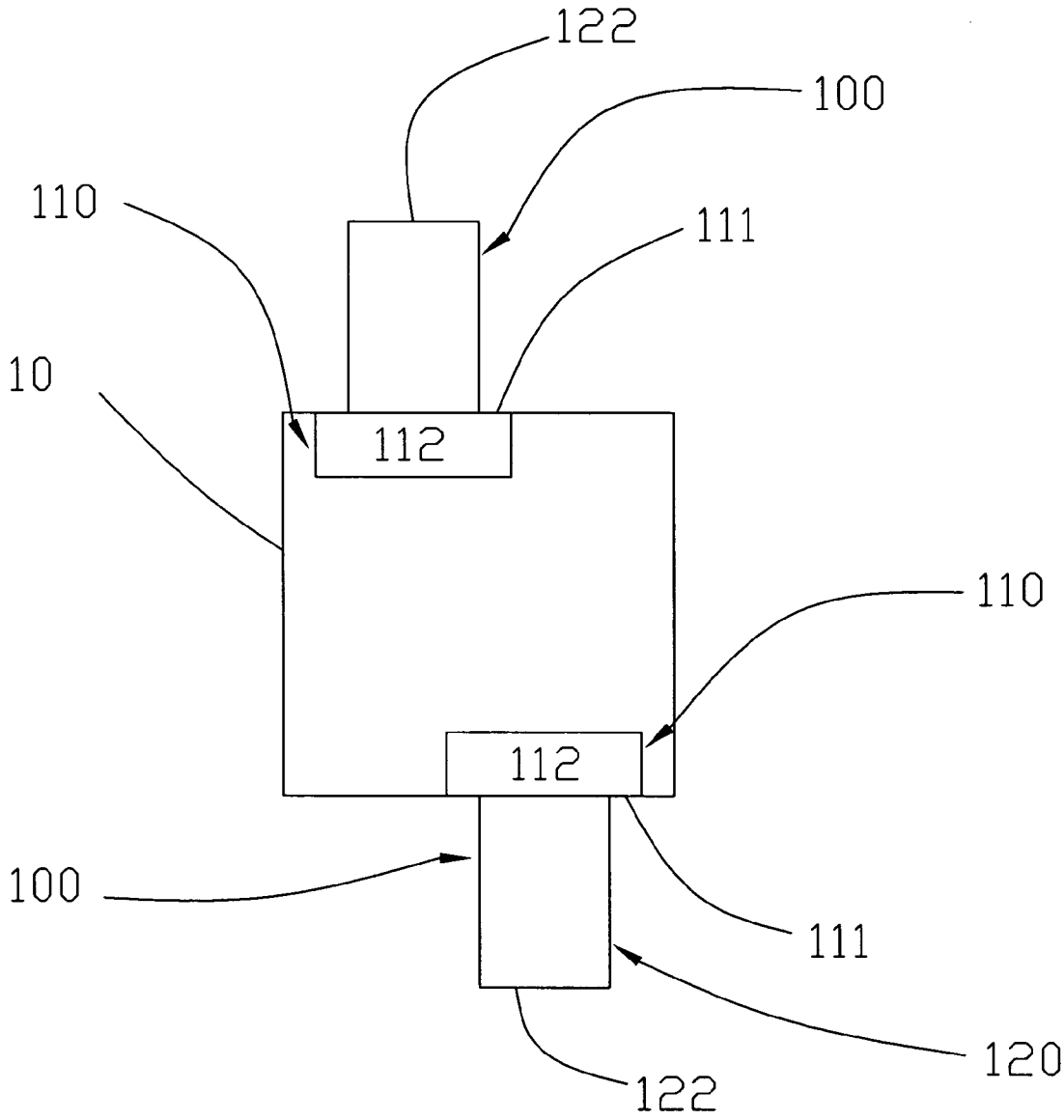
FIG. 4 is a sectional view of two sub-ducts as in FIG. 1 mounted adjacently in a main shaft.

A rectangular shape of the first portion 110 (or another shape incorporating the flat attachment wall 111) may reduce the overall profile of the sub-duct 100, and therefore reduce the pressure drop incurred by exhaust gases passing the sub-duct 100 in a main shaft 10. For example, a prior art four inch diameter round sub-duct 500 that has an outlet area of 12.57 square inches actually obstructs flow over a cross section having an area of at least 14.28 square inches due to the areas labeled 510 in FIG. 5. If replaced by a rectangular sub-duct 100 that has a cross sectional area of 12.57 square inches in the first portion 110 as discussed above, there is a reduction of approximately 12% in the obstructed cross sectional area in the main shaft 10, since the sub-duct 100 having a cross sectional area of 12.57 square inches in the first portion 110 only obstructs a cross section having an area of 12.57 square inches (FIG. 4). Notably, this reduction in the obstructed area in the main shaft 10 does not come at the expense of the cross-sectional areas inside the sub-duct 100. However, for the prior art sub-duct 500 to reduce the obstructed area in the main shaft 10 by 12%, instead of using a four inch diameter, a 3.75 inch diameter would have to be used—decreasing the cross-sectional area inside the sub-duct 500 by approximately 12%, which may be unacceptable.

Figure 5:
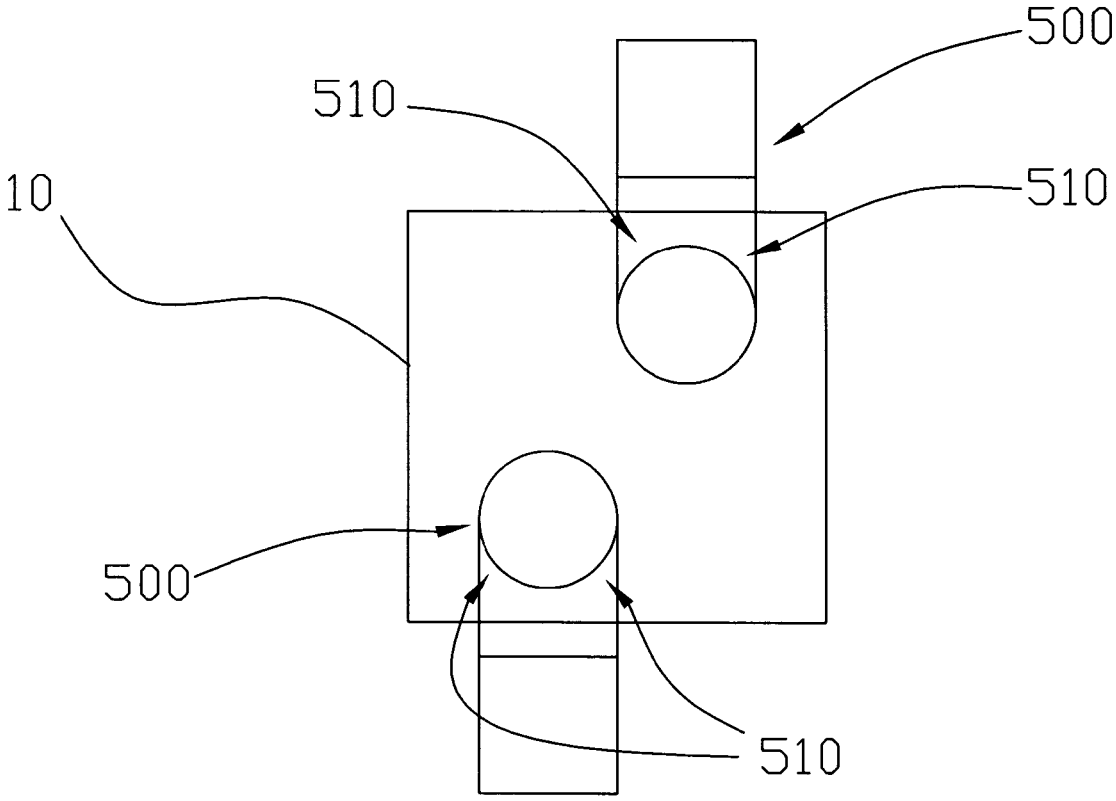
FIG. 5 PRIOR ART
FIG. 5 is a sectional view of two prior art sub-ducts mounted adjacently in a main shaft.

By reducing the pressure drop incurred in the main shaft 10 through utilizing the sub-duct 100, the size of the main shaft 10 may be reduced, allowing the building owner to recover valuable usable square footage. Alternately, a sub-duct 100 having a cross-sectional area in the first portion 110 that is larger than the cross-sectional area of the prior art sub-duct 500 may be used with no detrimental effect to the pressure drop in the main shaft 10, and a sub-duct 100 having a cross-sectional area in the first portion 110 that is as much as approximately 15% larger than the cross-sectional area of the prior art sub-duct 500 may be used with little detrimental effect to the pressure drop in the main shaft 10. The amount of pressure drop may be particularly important when multiple sub-ducts are mounted adjacently in the main shaft 10, as shown in FIGS. 4 and 5, as the effects are multiplied.

In one embodiment, the sub-duct 100 is a preformed metal duct constructed of 24-30 gauge galvanized steel or aluminum and of one-piece construction. However, other construction methods and materials could be used which would also fall within the scope of the present invention. Additionally, the sub-duct 100 may be attached to the main shaft 10 using an epoxy or other suitable bonding agent, or by fasteners such as screws and rivets.

Figure 6:
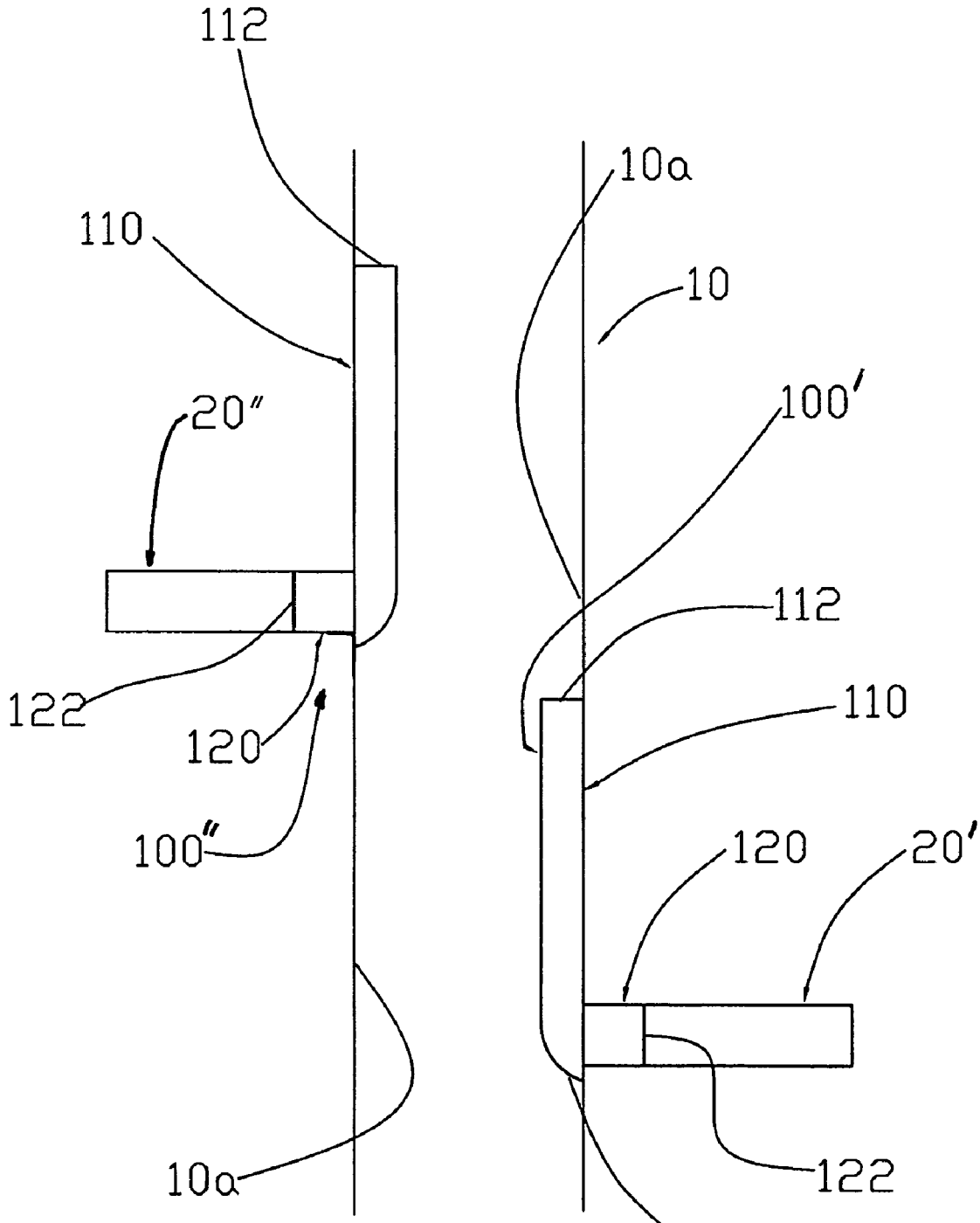
FIG. 6 is a side view of multiple sub-ducts as in FIG. 1 mounted in a main shaft.

FIG. 6 shows a method of exhausting into a generally rectangular and vertical main shaft 10 using a plurality of the sub-ducts 100 described above. A first sub-duct 100 is labeled 100' in FIG. 6, and a second sub-duct 100 is labeled 100" in FIG. 6. The attaching wall 111 of the first sub-duct 100' is coupled generally flush with an inner wall 10*a* of the main shaft 10 (e.g., through adhesive, welding, screws, rivets, and/or other fasteners) so that the first sub-duct 100' is aligned in a generally vertical direction with the top side opening 112 being above the bottom side 116 of the first sub-duct 100' and the second portion 120 of the first sub-duct 100'. The second portion 120 extends through the main shaft 10 in a generally horizontal direction as described above. A first exhaust duct 20 (labeled 20' in FIG. 6) may be coupled to the second portion 120 of the first sub-duct 100', such as through a clamp, adhesive, and/or another fastener. As noted above, the first exhaust duct 20' may be an appliance exhaust duct (e.g., a clothes dryer exhaust duct), a bathroom exhaust duct, etc.

The attaching wall of the second sub-duct 100" is coupled generally flush with either the same or a different inner wall 10*a* of the main shaft 10 so that the second sub-duct 100" is aligned in a generally vertical direction similar to that of the first sub-duct 100'. The second sub-duct 100" is shown coupled to the main shaft 10 at a location above the first sub-duct 100'. The second portion 120 of the second sub-duct 100" extends through the main shaft 10 in a generally horizontal direction, and a second exhaust duct 20 (labeled 20" in FIG. 6) is coupled to the second portion 120 of the second sub-duct 100". As noted above, the second exhaust duct 20" may be an appliance exhaust duct (e.g., a clothes dryer exhaust duct), a bathroom exhaust duct, etc.

Exhaust from the first exhaust duct 20' may be passed through the intake opening 122 of the first sub-duct 100', through the continuous channel 131 of the first sub-duct 100', out the top side opening 112 of the first sub-duct 100', and into the main shaft 10 to travel upwards. Exhaust from the second exhaust duct 20" may be passed through the intake opening 122 of the second sub-duct 100", through the continuous channel 131 of the second sub-duct 100", out the top side opening 112 of the second sub-duct 100", and into the main shaft 10 to travel upwards. The exhaust from the first exhaust duct 20' may pass along the aerodynamic configuration 117 of the second sub-duct 100" while traveling upwards through the main shaft 10, and the configuration and installation of the sub-ducts 100 may provide desirable flow characteristics and desirable amounts of pressure drop in the main shaft 10.

Those skilled in the art appreciate that variations from the specified embodiments disclosed above are contemplated herein, and it must be understood that the specific dimensions used herein are exemplary only. The description should not be restricted to the above embodiments, but should be measured by the following claims.

What is claimed is:

1. A method of exhausting into a generally rectangular and vertical main shaft, the method comprising the steps of:

providing a sub-duct comprising:

a hollow first portion presenting an attaching wall, a rectangular cross-section, a top side of the rectangular cross-section defining a top side opening, and a bottom side having a rounded configuration; and a hollow second portion defining an intake opening and meeting with the first portion attaching wall at approximately a ninety degree angle, the first and second portions collectively defining a continuous channel between the intake opening and the top side opening;

providing an exhaust duct;

coupling the sub-duct attaching wall flush with an inner wall of the main shaft wherein the entire hollow first portion is inside the main shaft, the sub duct being aligned in a generally vertical direction with the top side opening being above the bottom side and the second portion;

coupling the exhaust duct to the sub-duct second portion;

passing exhaust from the exhaust duct through the sub-duct intake opening, continuous channel, and top side opening, and into the main shaft, the exhaust being passed directly from the top side opening to the main shaft without further guidance from the sub-duct.

2. The method of claim 1, wherein the rounded configuration of the bottom side of the sub-duct first portion is rounded so that the attaching wall is longer than a wall of the first portion opposite the attaching wall, whereby exhaust traveling generally vertically and passing the sub-duct in the main shaft is guided around the sub-duct.

3. The method of claim 1, wherein:

the sub-duct first portion has a section of generally constant cross section extending from adjacent the second portion to the top side opening; and the sub-duct second portion has a generally constant cross section extending from the intake opening to the first portion.

4. The method of claim 3, wherein:

the generally constant cross section of the sub-duct first portion is rectangular and presents a first cross sectional area; and the generally constant cross section of the sub-duct second portion is rounded and presents a second cross sectional area.

5. The method of claim 4, wherein the first cross sectional area is between five percent less than the second cross sectional area and fifteen percent more than the second cross sectional area.

6. The method of claim 4, wherein the first cross sectional area is as large as the second cross sectional area but not more than thirteen percent larger than the second cross sectional area.

7. A method of exhausting into and through a generally rectangular and vertical main shaft having, an upper end with an exit, the method comprising the steps of:

providing a sub-duct comprising:

a hollow first portion having a generally flat attaching wall, a substantially rectangular cross-section, a top side of the rectangular cross-section defining a top side opening, and a bottom side having an aerodynamic configuration; and a hollow second portion defining an intake opening and meeting with the first portion attaching wall at approximately a ninety degree angle, the second portion having a configuration complementary to a configuration of an exhaust duct, the first and second portions collectively defining a continuous channel between the intake opening and the top side opening;

providing an exhaust duct;

coupling the sub-duct attaching wall flush with an inner wall of the main shaft wherein the entire hollow first portion is inside the main shaft, the sub-duct being aligned in a generally vertical direction with the top side opening being above the bottom side and the second portion;

coupling the exhaust duct to the sub-duct second portion;

passing exhaust from the exhaust duct through the sub-duct intake opening, continuous channel, and top side opening, into the main shaft, and upwardly to the upper end exit; the exhaust being passed directly from the top side opening into the main shaft without further guidance from the sub-duct.

8. The method of claim 7, wherein the aerodynamic configuration of the bottom side of the sub-duct first portion is selected from the group consisting of a rounded configuration and an angled configuration so that the attaching wall is longer than a wall of the first portion opposite the attaching wall, whereby exhaust traveling generally vertically and passing the sub-duct in the main shaft is guided around the sub-duct.

9. The method of claim 7, wherein:

the sub-duct first portion has a section of generally constant cross section extending from adjacent the second portion to the top side opening; and the sub-duct second portion has a generally constant cross section extending from the intake opening to the first portion.

10. The method of claim 9, wherein:

the generally constant cross section of the sub-duct first portion is rectangular and presents a first cross sectional area; and the generally constant cross section of the sub-duct second portion is rounded and presents a second cross sectional area.

11. The method of claim 10, wherein the first cross sectional area is between five percent less than the second cross sectional area and fifteen percent more than the second cross sectional area.

12. The method of claim 10, wherein the first cross sectional area is as large as the second cross sectional area but not more than thirteen percent larger than the second cross sectional area.

13. The method of claim 9, wherein:

the generally constant cross section of the sub-duct first portion presents a first cross sectional area;

the generally constant cross section of the sub-duct second portion presents a second cross sectional area; and the first cross sectional area is between five percent less than the second cross sectional area and fifteen percent more than the second cross sectional area.

14. A method of exhausting into and through a generally rectangular and vertical main shaft having an upper end with an exit, the method comprising the steps of:

providing first and second sub-ducts, each sub-duct comprising:

a hollow first portion presenting a generally flat attaching wall, a substantially rectangular cross-section, a top side of the rectangular cross-section defining a top side opening, and a bottom side having an aerodynamic configuration; and a hollow second portion defining an intake opening and meeting with the first portion attaching wall at approximately a ninety degree angle, the second portion having a configuration complementary to a configuration of an exhaust duct, the first and second portions collectively defining a continuous channel between the intake opening and the top side opening;

providing a first exhaust duct and a second exhaust duct;

coupling the attaching wall of the first sub-duct flush with an inner wall of the main shaft, the first sub-duct being aligned in a generally vertical direction with the top side opening of the first sub-duct being above the bottom side of the first sub-duct and the second portion of the first sub-duct;

coupling the attaching wall of the second sub-duct flush with an inner wall of the main shaft at a location above the first sub-duct, the second sub-duct being aligned in a generally vertical direction with the top side opening of the second sub-duct being above the bottom side of the second sub-duct and the second portion of the second sub-duct;

coupling the first exhaust duct to the second portion of the first sub-duct;

coupling the second exhaust duct to the second portion of the second sub-duct;

passing exhaust from the first exhaust duct through the intake opening of the first sub-duct, the continuous channel of the first sub-duct, the top side opening of the first sub-duct, and into the main shaft to travel upwards to the shaft exit, the exhaust being passed directly from the top side opening of the first sub-duct to the main shaft without further guidance from the first sub-duct; and passing exhaust from the second exhaust duct through the intake opening of the second sub-duct, the continuous channel of the second sub-duct, the top side opening of the second sub-duct, and into the main shaft to travel upwards to the shaft exit, the exhaust being passed directly from the top side opening of the second sub-duct to the main shaft without further guidance from the second sub-duct.

15. The method of claim 14, further comprising the step of passing the exhaust from the first exhaust duct along the aerodynamic configuration of the second sub-duct.

16. The method of claim 14, wherein:

each respective sub-duct first portion has a section of generally constant cross section extending from adjacent a respective second portion to a respective top side opening; and each respective sub-duct second portion has a generally constant cross section extending from a respective intake opening to a respective first portion.

17. The method of claim 16, wherein:

the generally constant cross section of each respective first portion is rectangular; and the generally constant cross section of each respective second portion is rounded.

18. The method of claim 16, wherein:

the generally constant cross section of the first portion of the first sub-duct presents a first cross sectional area;

the generally constant cross section of the second portion of the first sub-duct presents a second cross sectional area;

the first cross sectional area of the first sub-duct is between five percent less than the second cross sectional area of the first sub-duct and fifteen percent more than the second cross sectional area of the first sub-duct;

the generally constant cross section of the first portion of the second sub-duct presents a first cross sectional area;

the generally constant cross section of the second portion of the second sub-duct presents a second cross sectional area; and the first cross sectional area of the second sub-duct is between five percent less than the second cross sectional area of the second sub-duct and fifteen percent more than the second cross sectional area of the second sub-duct.

* * * * *